US011044955B2

(12) United States Patent
Williams

(10) Patent No.: US 11,044,955 B2
(45) Date of Patent: Jun. 29, 2021

(54) SPORT GARMENT CELLPHONE CASE APPARATUS

(71) Applicant: Marckus Williams, Indianapolis, IN (US)

(72) Inventor: Marckus Williams, Indianapolis, IN (US)

( * ) Notice: Subject to any disclaimer, the term of this patent is extended or adjusted under 35 U.S.C. 154(b) by 107 days.

(21) Appl. No.: 16/573,159

(22) Filed: Sep. 17, 2019

(65) Prior Publication Data

US 2021/0076756 A1 Mar. 18, 2021

(51) Int. Cl.

| | |
|---|---|
| ***A41D 27/20*** | (2006.01) |
| ***A41D 1/00*** | (2018.01) |
| ***A41D 13/012*** | (2006.01) |

(52) U.S. Cl.

CPC ..... *A41D 1/002* (2013.01); *A41D 13/012* (2013.01); *A41D 27/205* (2013.01)

(58) Field of Classification Search

CPC ..... A41D 1/002; A41D 13/012; A41D 27/20; A41D 27/205

See application file for complete search history.

(56) References Cited

U.S. PATENT DOCUMENTS 2,709,815 A 6/1955 Nelson
2,908,306 A * 10/1959 Chorost ..... A45C 13/185 150/134
3,193,842 A * 7/1965 Bell ..... A41D 27/20 2/94
4,670,909 A * 6/1987 Forrester ..... A41D 19/002 2/160
5,421,032 A 6/1995 Murphy
5,878,441 A 3/1999 Busker
5,946,732 A * 9/1999 Richards ..... A44C 3/001 2/247
D422,666 S 4/2000 Wagner
6,339,846 B2 1/2002 Uchida
6,826,782 B2 12/2004 Jordan
8,549,670 B2 10/2013 Demus
8,899,458 B1 * 12/2014 Heien ..... A45F 5/021 224/675
8,925,115 B1 * 1/2015 Hanna ..... F41H 1/02 2/102
9,282,777 B2 * 3/2016 Diakite ..... A41D 27/20
2010/0175161 A1 7/2010 Jarboe
2012/0185999 A1 7/2012 Raviv
2012/0186000 A1 * 7/2012 Raviv ..... A41B 1/00 2/247

(Continued)

*Primary Examiner* — Tajash D Patel

(57) ABSTRACT

A sport garment cellphone case apparatus for securing and waterproofing a cellphone for use in sports includes a sport garment being configured to be worn by a user while performing an activity. A case holder is coupled to the sport garment and comprises a plurality of L-shaped corners. Each of the corners has a sidewall extending from a breast of the sport garment and a front wall perpendicularly extending from the sidewall. A tether is coupled to the sport garment. The tether has a proximal end coupled to the breast of the sport garment between the corners of the case holder and a distal end. A case is coupled to the tether and comprises a case back coupled to the distal end and a case front coupled to the case back. The case front is selectively engageable with the case back and is configured to sealingly contain a cellphone.

11 Claims, 4 Drawing Sheets

(56) References Cited

U.S. PATENT DOCUMENTS

| | | | | |
|---|---|---|---|---|
| 2015/0003656 | A1* | 1/2015 | Pardo | A41D 7/005<br>381/334 |
| 2016/0073717 | A1 | 3/2016 | Jon Mulshenock | |
| 2016/0248265 | A1* | 8/2016 | Oo | H04B 5/0075 |
| 2017/0224028 | A1* | 8/2017 | Kim | H02J 7/0045 |
| 2019/0380398 | A1* | 12/2019 | Plant | A41D 27/10 |

* cited by examiner

SPORT GARMENT CELLPHONE CASE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cellphone accessory devices and more particularly pertains to a new cellphone accessory device for securing and waterproofing a cellphone for use in sports.

(2) Description of Related Art Including Information Disclosed Under 37 CFR 1.97 and 1.98

The prior art relates to cellphone accessory devices.

BRIEF SUMMARY OF THE INVENTION

An embodiment of the disclosure meets the needs presented above by generally comprising a sport garment being configured to be worn by a user while performing an activity. A case holder is coupled to the sport garment and comprises a plurality of L-shaped corners. Each of the corners has a sidewall extending from a breast of the sport garment and a front wall perpendicularly extending from the sidewall. A tether is coupled to the sport garment. The tether has a proximal end coupled to the breast of the sport garment between the corners of the case holder and a distal end. A case is coupled to the tether and comprises a case back coupled to the distal end and a case front coupled to the case back. The case front is selectively engageable with the case back and is configured to sealingly contain a cellphone.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
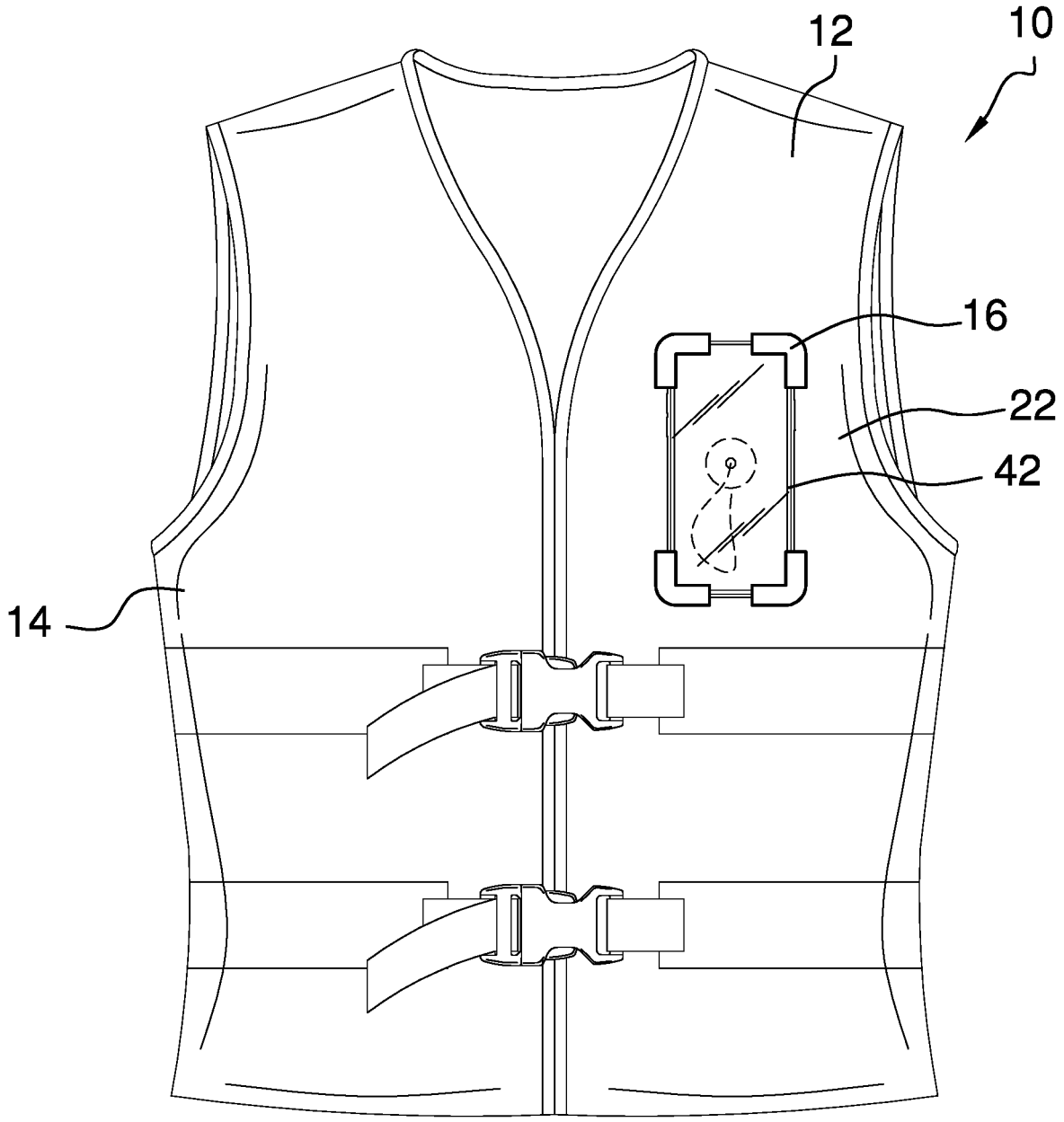
FIG. 1 is a front elevation view of a sport garment cellphone case apparatus according to an embodiment of the disclosure.
Figure 2:
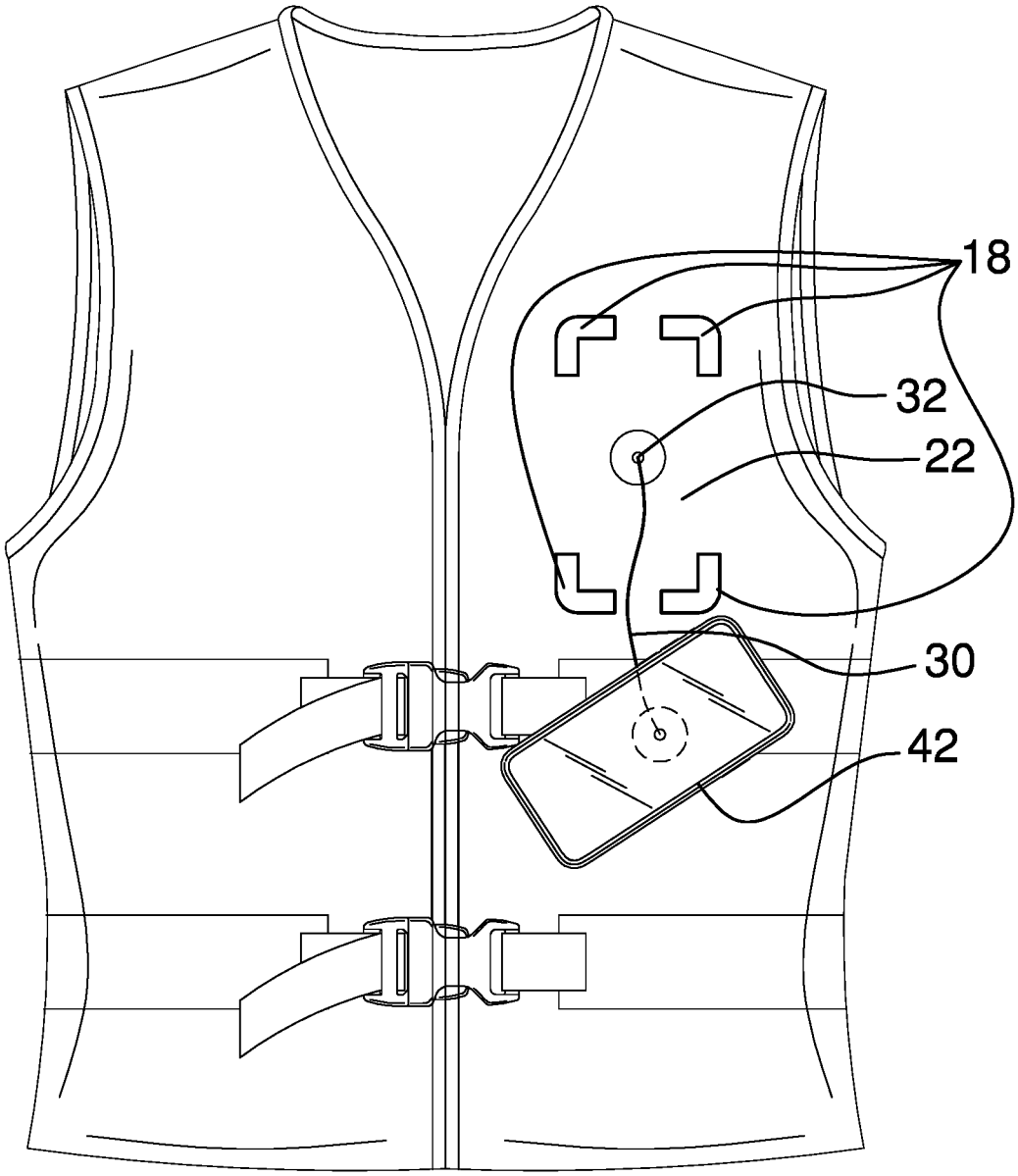
FIG. 2 is a front elevation view of an embodiment of the disclosure.
Figure 3:
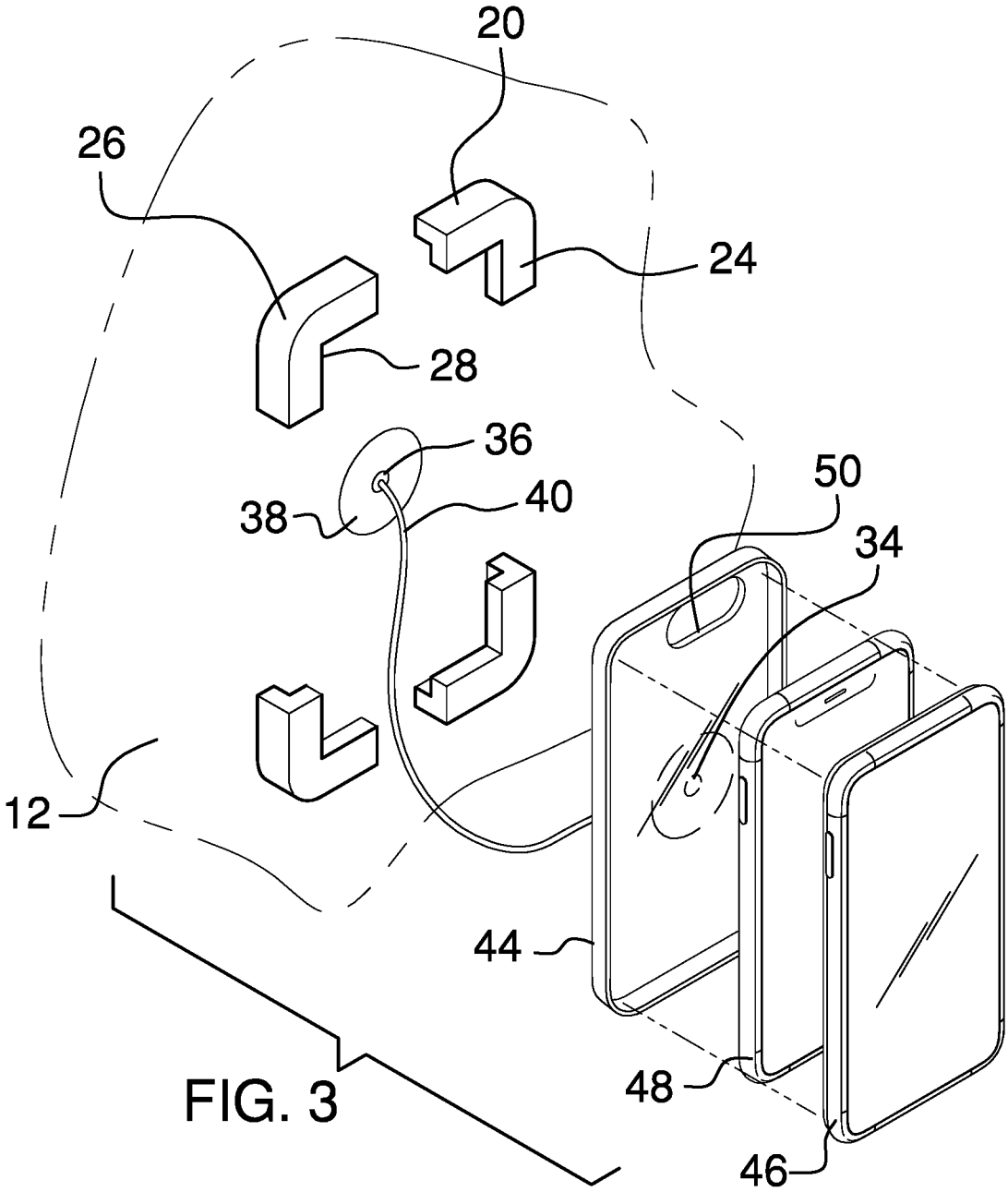
FIG. 3 is an in-use view of an embodiment of the disclosure.
Figure 4:
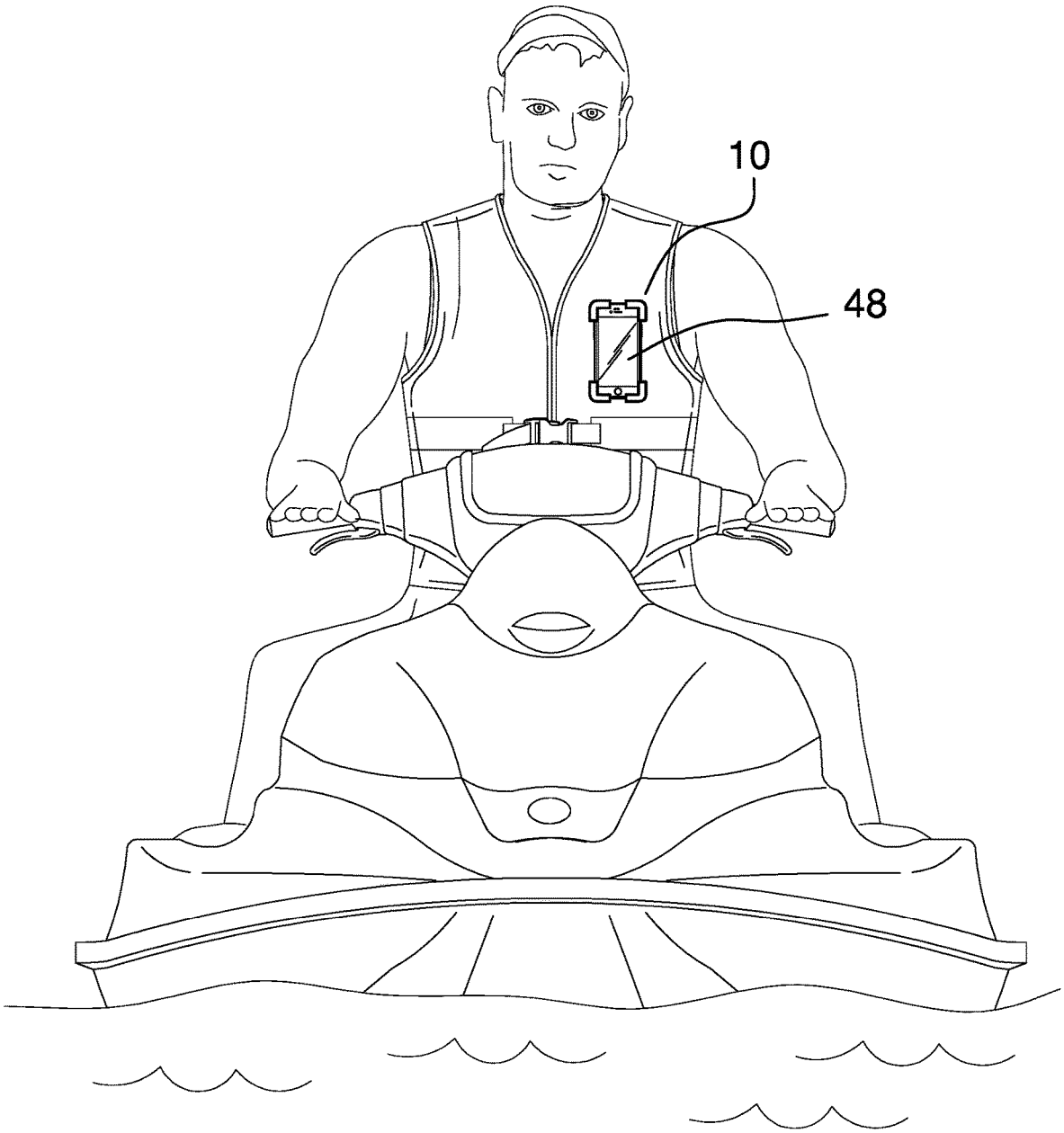
FIG. 4 is an in-use view of an embodiment of the disclosure.

With reference now to the drawings, and in particular to FIGS. 1 through 4 thereof, a new cellphone accessory device embodying the principles and concepts of an embodiment of the disclosure and generally designated by the reference numeral 10 will be described.

As best illustrated in FIGS. 1 through 4, the sport garment cellphone case apparatus 10 generally comprises a sport garment 12 being configured to be worn by a user while performing an activity. The sport garment 12 may be a life vest 14 or other type of sport garment such as, but not limited to, a wetsuit, a rash guard, and the like. A case holder 16 is coupled to the sport garment 12. The case holder 16 comprises a plurality of L-shaped corners 18. Each of the corners 18 has a sidewall 20 extending from a breast 22 of the sport garment 12 and a front wall 24 perpendicularly extending from the sidewall 20. The sidewall 20 of each corner 18 has a rounded outer corner 26 and the front wall 24 of each corner 18 has a perpendicular inner corner 28. A depth of the sidewall 20 is equal to a width of the front wall 24. The case holder 16 is rubberized. A tether 30 is coupled to the sport garment 12. The tether 30 has a proximal end 32 coupled to the breast 22 of the sport garment 12 between the corners 18 of the case holder 16 and a distal end 34. Each of the proximal end 32 and the distal end 34 have a circular inner attachment portion 36 and a circular main attachment portion 38 concentrically extending from the inner attachment portion 36. A cord portion 40 of the tether 30 extends from the inner attachment portion 36 of the proximal end 32 to the inner attachment portion 36 of the distal end 34. The cord portion 40 is elasticized. A case 42 is coupled to the tether 30. The case 42 comprises a case back 44 coupled to the distal end 34 and a case front 46 coupled to the case back 44. The case front 46 is selectively engageable with the case back 44 and is configured to sealingly contain a cellphone 48. The case back 44 has a camera aperture 50 extending therethrough. Each of the corners 18 is sufficiently flexible to receive the case 42.

In use, the sport garment 12 is worn by the user. The cellphone 48 is inserted into the case 42 and the tether 30 secures the case 42 to the sport garment 12. The user may place the case 42 into the case holder 16 or hold the case 42 with her hand. The tether 30 prevents the cellphone 48 from being lost.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A sport garment cellphone case apparatus comprising:

a sport garment, the sport garment being configured to be worn by a user while performing an activity;

a case holder coupled to the sport garment, the case holder comprising a plurality of L-shaped corners, each of the corners having a sidewall extending from a breast of the sport garment and a front wall perpendicularly extending from the sidewall;

a tether coupled to the sport garment, the tether having a proximal end coupled to the breast of the sport garment between the corners of the case holder and a distal end; and a case coupled to the tether, the case comprising a case back coupled to the distal end and a case front coupled to the case back, the case front being selectively engageable with the case back and configured to sealingly contain a cellphone.

2. The sport garment cellphone case apparatus of claim 1 further comprising the sidewall of each corner having a rounded outer corner.

3. The sport garment cellphone case apparatus of claim 1 further comprising the front wall of each corner having a perpendicular inner corner.

4. The sport garment cellphone case apparatus of claim 1 further comprising the tether being elasticized.

5. The sport garment cellphone case apparatus of claim 1 further comprising a depth of the sidewall being equal to a width of the front wall.

6. The sport garment cellphone case apparatus of claim 1 further comprising the case back having a camera aperture extending therethrough.

7. The sport garment cellphone case apparatus of claim 1 further comprising the sport garment being a life vest or other type of sport garment such as, but not limited to, a wetsuit, a rash guard, and the like.

8. The sport garment cellphone case apparatus of claim 1 further comprising the case holder being rubberized, each of the corners being sufficiently flexible to receive the case.

9. The sport garment cellphone case apparatus of claim 1 further comprising each of the proximal end and the distal end of the tether having a circular inner attachment portion and a circular main attachment portion concentrically extending from the inner attachment portion, a cord portion of the tether extending from the inner attachment portion of the proximal end to the inner attachment portion of the distal end.

10. A sport garment cellphone case apparatus comprising:

a sport garment, the sport garment being configured to be worn by a user while performing an activity;

a case holder coupled to the sport garment, the case holder comprising a plurality of L-shaped corners, each of the corners having a sidewall extending from a breast of the sport garment and a front wall perpendicularly extending from the sidewall, the sidewall of each corner having a rounded outer corner and the front wall of each corner having a perpendicular inner corner, a depth of the sidewall being equal to a width of the front wall, the case holder being rubberized;

a tether coupled to the sport garment, the tether having a proximal end coupled to the breast of the sport garment between the corners of the case holder and a distal end, each of the proximal end and the distal end having a circular inner attachment portion and a circular main attachment portion concentrically extending from the inner attachment portion, a cord portion of the tether extending from the inner attachment portion of the proximal end to the inner attachment portion of the distal end, the cord portion being elasticized; and a case coupled to the tether, the case comprising a case back coupled to the distal end and a case front coupled to the case back, the case front being selectively engageable with the case back and configured to sealingly contain a cellphone, the case back having a camera aperture extending therethrough, each of the corners being sufficiently flexible to receive the case.

11. A sport garment cellphone case apparatus comprising:

a sport garment, the sport garment being a life vest or other type of sport garment such as, but not limited to, a wetsuit, a rash guard, and the like, the sport garment being configured to be worn by a user while performing a water activity;

a case holder coupled to the sport garment, the case holder comprising a plurality of L-shaped corners, each of the corners having a sidewall extending from a breast of the sport garment and a front wall perpendicularly extending from the sidewall, the sidewall of each corner having a rounded outer corner and the front wall of each corner having a perpendicular inner corner, a depth of the sidewall being equal to a width of the front wall, the case holder being rubberized;

a tether coupled to the sport garment, the tether having a proximal end coupled to the breast of the sport garment between the corners of the case holder and a distal end, each of the proximal end and the distal end having a circular inner attachment portion and a circular main attachment portion concentrically extending from the inner attachment portion, a cord portion of the tether extending from the inner attachment portion of the proximal end to the inner attachment portion of the distal end, the cord portion being elasticized; and a case coupled to the tether, the case comprising a case back coupled to the distal end and a case front coupled to the case back, the case front being selectively engageable with the case back and configured to sealingly contain a cellphone, the case back having a camera aperture extending therethrough, each of the corners being sufficiently flexible to receive the case.

* * * * *